US011335519B2

(12) United States Patent
Court

(10) Patent No.: US 11,335,519 B2
(45) Date of Patent: May 17, 2022

(54) ELECTRICAL CURRENT SWITCHING UNIT

(71) Applicant: Schneider Electric Industries SAS, Rueil Malmaison (FR)

(72) Inventor: Frédéric Court, Saint-Nicolas-de-Macherin (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 11 days.

(21) Appl. No.: 17/128,564

(22) Filed: Dec. 21, 2020

(65) Prior Publication Data

US 2021/0193404 A1 Jun. 24, 2021

(30) Foreign Application Priority Data

Dec. 23, 2019 (FR) ..... 1915470

(51) Int. Cl.
*H01H 5/06* (2006.01)
*H01H 3/30* (2006.01)
*H01H 71/04* (2006.01)

(52) U.S. Cl.
CPC ..... *H01H 5/06* (2013.01); *H01H 3/3015* (2013.01); *H01H 71/04* (2013.01)

(58) Field of Classification Search
CPC ..... H01H 5/06; H01H 3/3015; H01H 71/04; H01H 3/60; H01H 71/52; H01H 71/529
USPC ..... 200/288, 244; 335/46, 193
See application file for complete search history.

(56) References Cited

U.S. PATENT DOCUMENTS 4,267,419 A * 5/1981 Maier ..... H01H 71/504 200/288
5,571,255 A * 11/1996 Baginski ..... H01H 3/60 200/401
9,373,457 B2 6/2016 Roelandt et al.

FOREIGN PATENT DOCUMENTS

DE 102006012125 B3 11/2007
FR 2717617 A1 9/1995

OTHER PUBLICATIONS

Republique Francaise Institut National De La Propriete Industrielle, French Search Report and Opinion for French Patent Application No. FR1915470 dated Sep. 10, 2020, 7 pages.

* cited by examiner

*Primary Examiner* — Edwin A. Leon
*Assistant Examiner* — Iman Malakooti
(74) *Attorney, Agent, or Firm* — Locke Lord LLP

(57) ABSTRACT

A switching unit for switching an electrical current, the unit comprising separable fix and mobile electrical contacts and a mechanism capable of switching over the contacts between a closed state and an open state. The mechanism comprises a switching shaft coupled to a mobile electrical contact, a trip hook mounted to be pivoted on a fixed support of the mechanism and comprising a bore in which is housed an abutment and a link system coupling the switching shaft to the trip hook. The link system comprises an articulated linkage, which is rotationally linked with respect to the trip hook and which comprises a main bearing surface, which bears on the abutment when the switching mechanism is in the closed state. The abutment is configured to be elastically deformed when the switching mechanism passes from the open state to the closed state and the linkage exerts an effect on the abutment, so as to damp the impact of the linkage on the abutment.

15 Claims, 4 Drawing Sheets

ELECTRICAL CURRENT SWITCHING UNIT

TECHNICAL FIELD

The present invention concerns a switching unit for switching an electrical current.

The invention relates in particular to the field of electrical switching units intended to interrupt an electrical current, such as circuit breakers or switches.

BACKGROUND

Switching units having separable contacts comprise a switching mechanism using energy storage, the function of which is to move the electrical contacts of the unit between an open state and a closed state, for example in response to an action by a tripping device or by a user.

An example of such a mechanism is described in FR-2 985 600-B1.

For example, a pivoting mobile electrical contact is moved by a switching shaft mechanically coupled to a trip hook by means of a link system. In order to close the contacts, a mechanical energy store comprising one or more springs is actuated in order to set the link system in motion.

The switching mechanism is therefore subject to numerous mechanical stresses, such as internal impacts, whenever the contacts open and close.

Such mechanisms have been satisfactory for a long time. In some contemporary applications, however, the increase in electrical powers associated with switching units, along with normative requirements, require the capacity of the mechanical energy stores to be increased in order to increase the speed at which the contacts close, which places more stress on the switching mechanism and reduces the number of opening and closing cycles acceptable over the life of the product.

In order to reduce the stresses on the switching mechanism, it is known practice to slow down or damp the switching shaft by using a device external to the switching mechanism. However, such a solution creates additional bulk and has a limited effect on increasing the life of the switching mechanisms.

It is also known practice to strengthen the mechanical parts, in particular by increasing their respective thicknesses, but such a solution exacerbates inertial effects, which limits the benefits actually obtained in terms of life.

It is desirable to be able to have switching mechanisms with improved durability, for example in order to increase the number of opening and closing cycles acceptable over the life of the product.

SUMMARY

There is therefore a need for a switching unit for switching an electrical current in which the switching mechanism has improved reliability, without resorting to the addition of parts outside the mechanism.

With this in mind, the invention concerns a switching unit for switching an electrical current, comprising separable fixed and mobile electrical contacts and a mechanism capable of switching over the contacts between a closed state and an open state. The mechanism comprises:

- a switching shaft coupled to a mobile electrical contact,
- a trip hook mounted to be pivoted on a fixed support of the mechanism and comprising a bore in which is housed an abutment,

- a link system coupling the switching shaft to the trip hook. The link system comprises an articulated linkage, which is rotationally linked with respect to the trip hook and which comprises a main bearing surface, which bears on the abutment when the switching mechanism is in the closed state. According to the invention, the abutment is configured to be elastically deformed when the switching mechanism passes from the open state to the closed state and the linkage exerts an effect on the abutment, so as to damp the impact of the linkage on the abutment.

With the invention, the abutment is elastically deformable and allows the kinetic energy of the linkage to be absorbed, prolonging the life of the mechanism. This effect is achieved without adding a part outside the mechanism, which is advantageous in terms of bulk and cost.

Advantageously, elastomeric damping elements, situated at the level of the abutment, damp the linkage before it bears on the abutment, which further improves the absorption of kinetic energy each time the mechanism passes from the open state to the closed state.

According to some advantageous but non-obligatory aspects of the invention, such a support can incorporate one or more of the following features taken in any technically acceptable combination:

- the abutment is made from high-elasticity steel;
- the abutment comprises a spiral pin;
- the abutment is held in the bore of the trip hook by means of elastic return of the abutment;
- the switching unit comprises elastically deformable damping elements, the damping elements being in a relaxed configuration when the switching mechanism is in the open state, whereas, when the switching mechanism is in the closed state, secondary bearing surfaces of the linkage bear on respective bearing portions of the damping elements and the damping elements are in a deformed configuration;
- the damping elements are each situated at the level of a respective end of the abutment and each comprise an orifice to hold them on the abutment, each damping element also comprising a through-slot, so that in the closed state of the switching unit the main bearing surface of the linkage bears directly on the abutment;
- each damping element comprises a front portion and a rear portion, the front and rear portions being situated on either side of the through-slot and being configured so as, when the trip mechanism passes from the open state to the closed state, to come into contact with the secondary bearing surfaces of the linkage before the main bearing surface of the linkage bears directly on the abutment;
- the damping elements comprise deformable cavities made in the front portion, the cavities being open when the damping elements are in a relaxed configuration, whereas when the switching unit is in the closed state the cavities are closed;
- the damping elements are configured so that the cavities in the front portion each have a respective thickness measured parallel to a mean bearing direction, the sum of the thicknesses being between 30% and 70% of a dimension of the front portion measured parallel to the mean bearing direction, preferably between 40% and 60%, the mean bearing direction being defined by the direction of the contact force between the linkage and the front portion when the switching unit passes from the open state to the closed state;

the damping elements are made from an elastomer material having a Shore A hardness of between 50° and 90°, preferably between 60° and 80°, more preferably substantially equal to 70°;

the switching mechanism comprises two spacer strips, which are integral with the trip hook and are each situated at the level of a respective damping element, each spacer strip having support faces configured to interact in a form fit with lower faces of the damping elements, the lower faces being situated opposite the front and rear portions in the mean bearing direction of the linkage, so that, in a deformed configuration, the damping elements are deformed by compression, and the front portions of the damping elements partially jut out beyond the support faces, so that when the switching unit is in the closed state the front portion of each damping element also comprises an area of deformation by tension.

BRIEF DESCRIPTION OF THE DRAWINGS

The invention will be better understood and other advantages thereof will emerge more clearly in the light of the description that follows of an embodiment of a switching unit for switching an electrical current in accordance with its principle, said description being provided solely by way of example and with reference to the appended drawings, in which.

DETAILED DESCRIPTION

Figure 1:
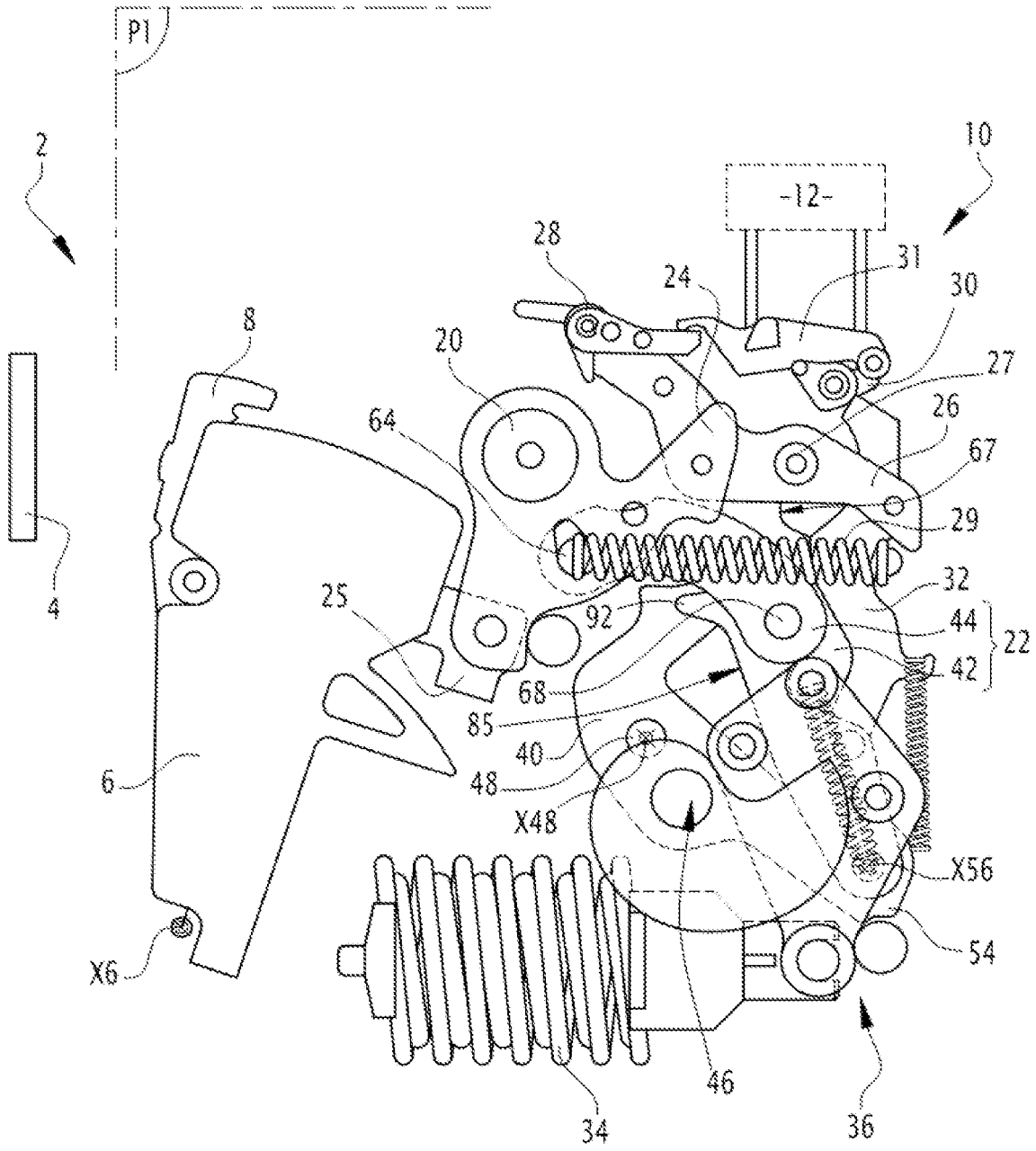
FIG. 1 schematically illustrates a switching unit having separable contacts, which is shown in cross-section on a median plane, comprising a switching mechanism having a linkage according to the invention, the mechanism and the linkage being shown in simplified fashion in a first configuration.

FIG. 1 shows part of an electrical switching unit 2 for interrupting an electrical current, such as a circuit breaker or a contactor. The switching of the electrical current is performed in air and by means of separable electrical contacts.

According to some examples, the unit 2 is a low-voltage high-current multipole circuit breaker.

The unit 2 comprises a fixed electrical contact 4 and a mobile pole 6 that, in some examples, bears contact fingers 8 mounted to be pivoted and arranged opposite the fixed contact 4. The contacts 4 and 8 are connected to opposite electrical connection terminals of the unit 2.

The mobile pole 6 is reversibly movable, for example by pivoting in relation to a fixed frame of the unit 2, between an open position and a closed position of the contacts, corresponding to an electrically open state and an electrically closed state of the unit 2, respectively. The axis of rotation of the mobile pole 6 is denoted by the reference X6 here.

The unit 2 also comprises a switching mechanism 10 adapted to switch over the contacts 4 and 8 between the open and closed states by moving the mobile pole 6 between the open and closed positions.

The contact finger 8, borne by the mobile pole 6, is by extension a mobile electrical contact, which is rotatably mobile in relation to the frame of the unit 2 about the axis of rotation X6, in particular during the switching movements of the unit 2 between the electrically open and closed states.

For convenience, a median plane P1 is defined for illustrative purposes as being a plane orthogonal to the axis X6. The median plane P1 is also the plane of the image in FIG. 1. In the embodiments illustrated, the pivoting and rotation movements of the elements of the mechanism 10 take place about axes of rotation that are fixed in relation to the frame and that extend parallel to one another, in this instance in directions perpendicular to the plane P1.

For example, the mechanism 10 is controllable by means of a tripping device 12 of the unit 2 and/or by a manual control device, such as a joystick or a push-button.

According to some embodiments, the unit 2 is a multipole unit adapted to interrupt a polyphase electrical current. The unit 2 thus comprises multiple poles, each of which is associated with one electrical phase and comprises a pair of contacts 4 and 8. According to some non-limiting examples, the unit 2 comprises three, four, six or eight poles.

According to some implementations, the mechanism 10 is a switching mechanism using mechanical energy storage. The operating principle of a switching mechanism based on this technology is described in FR-2 985 600-B1, for example.

The mechanism 10 comprises in particular a switching shaft 20 coupled to the mobile pole 6, in this instance by means of a crank 24 and a connecting rod 25. The shaft 20 is rotatably mobile about its longitudinal axis in relation to a fixed frame, or fixed support, of the switching unit 2. In other words the switching shaft 20 is coupled to the contact finger 8, which is a mobile contact.

When the unit 2 comprises multiple poles, the shaft 20 is common to all of the poles and is mechanically coupled to each mobile pole 6.

The mechanism 10 also comprises a trip hook 40 and a link system 22 coupling the switching shaft to the trip hook.

For example, the link system 22 is articulated by a pivot link to one arm of the crank 24 borne by the shaft 20, as described hereinafter.

The mechanism 10 also comprises an opening pawl 26 associated with a bolt 28, also called «half-moon».

The opening pawl 26 is mounted to be pivoted in relation to the frame and interacts with the trip hook 40. A spring 29 is engaged between, firstly, the shaft 20 and, secondly, an axis integral with the frame of the unit 2.

A closing bolt 30, also called «half-moon», and an intermediate lever 31 mechanically interact with an actuator controlled by the tripping device 12, such as an electromagnetic actuator having a coil, and/or with the manual control device. FIG. 1 schematically depicts the association between the tripping device and the lever 31 by means of rods, although in practice this mechanical interaction can be produced in quite a different manner.

The bolt 30 is also mechanically associated with a closing pawl 32 mounted to be pivoted in relation to the frame.

The mechanism 10 moreover comprises a mechanical energy storage device 34, comprising at least one spring. For example, the device 34 stores mechanical energy when the spring is compressed and releases this mechanical energy when the spring is relaxed.

A drive mechanism 36, in this instance comprising one or more link parts articulated and/or mounted to be pivoted in relation to the fixed frame, is mechanically coupled to the device 34. The drive mechanism 36 acts on the link system 22 in order to strike it and drive it towards a closed position. In this manner, by moving, the link system 22 in turn drives the trip hook 40.

In the example illustrated, the trip hook 40 also bears an orifice 46 that is used to receive a pivot link to the frame and is articulated by a pivot link to the link system 22.

Figure 2:
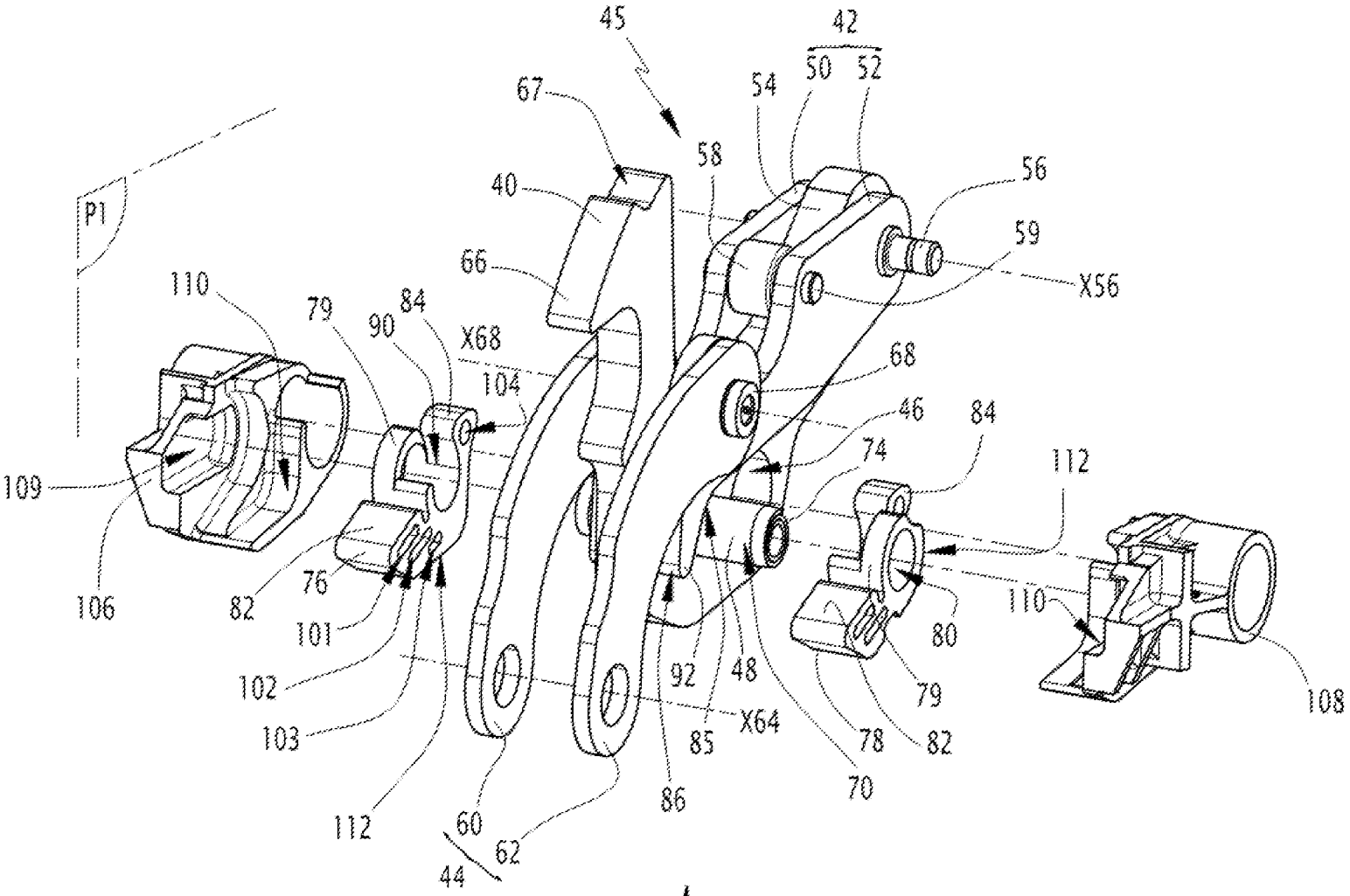
FIG. 2 is a partially exploded perspective view of the linkage in FIG. 1, the linkage being in a second configuration.

The link system 22 and the hook 40 are also shown in more detail in FIG. 2.

The link system 22 comprises a first pair of connecting rods 42 and a second pair of connecting rods 44, which are articulated to one another and on which are formed the pivot links for articulation to the trip hook 40 and the shaft 20. The two pairs of connecting rods 42 and 44 together form an articulated «linkage» 45.

In the example illustrated, the trip hook 40 also bears an orifice 46, which is used to receive a pivot link to the frame, and an abutment 48, which is housed in a bore of the hook 40 and in this instance projects on either side of the hook 40. For example, the trip hook 40 has an essentially flat shape, parallel to the median plane P1.

According to some embodiments, as will be understood on reading the examples provided hereinafter, the abutment 48 is more generally configured to be elastically deformed when the switching mechanism 10 passes from the open state to the closed state and the linkage 45 exerts an effect on the abutment, so as to damp the impact of the linkage 45 on the abutment 48.

The first pair 42 of connecting rods comprises two similar or identical connecting rods 50 and 52 arranged parallel opposite one another. According to some examples, the connecting rods 50 and 52 have a flat shape.

A first end, in this instance a lower end, of each of the connecting rods 50 and 52 is mounted to be pivoted on the trip hook 40 and, more precisely, on a distal end 54 of the trip hook 40.

This pivot link in this instance is formed by means of a rigid axis 56, such as a trunnion, which extends perpendicularly with respect to the connecting rods 50 and 52. The reference X56 denotes the axis of rotation associated with this pivot link. The axis X56 is parallel to the axis X6 in this instance.

According to some examples, the link system 22 also comprises a bush 58 mounted between the connecting rods 50 and 52 on a spacer strip 59 that secures the connecting rods 50 and 52 to one another. The spacer strip 59 extends parallel to the axis X56 in this instance.

For example, the spacer strip 59 and the bush 58 are struck by the drive mechanism 36 when the energy is released by the device 34.

The second pair 44 of connecting rods comprises two similar or identical connecting rods 60 and 62 arranged parallel opposite one another. According to some examples, the connecting rods 60 and 62 have a flat shape.

According to some optional but nevertheless advantageous embodiments, each of the second connecting rods 60 and 62 has a shape bent in an arc, reducing bulk, improving the distribution of the mechanical stresses and increasing the mechanical toughness of the system 22.

A first end, in this instance an upper end, of the connecting rods 60 and 62 is adapted to be mounted to be pivoted on the shaft 20, and more precisely, on one arm of the crank 24, in this instance in an orifice formed in this arm of the crank 24.

This pivot link is formed by means of a rigid axis 64, which extends perpendicularly with respect to the connecting rods 60 and 62, preferably projecting in relation to the outer lateral faces of the connecting rods 60 and 62. The reference X64 denotes the axis of rotation associated with this pivot link. The axis X64 is parallel to the axis X56 in this instance. The rigid axis 64 is placed on said first end of the connecting rods 60 and 62.

According to some examples, the rigid axis 64 is mounted so as to be translationally linked to the connecting rods 60 and 62. In other words, the rigid axis 64 is rotationally mobile, but remains translationally immobile in relation to the connecting rods 60 and 62.

The connecting rods 60 and 62 forming the second pair of connecting rods 44 are held at a distance from one another in the direction X64 so as to allow the passage of an end 66 of the trip hook 40 between the connecting rods 60 and 62.

This end 66 has a V-shaped fastening portion 67, which interacts with the opening pawl 26, for example by coming to bear on an abutment linked to an axis 27 of the opening pawl 26 in the closed position.

The connecting rods 50 and 52 are connected to the connecting rods 60 and 62 means of a single axis of articulation 68 that forms a pivot link between the connecting rods 50 and 52 of the first pair 42 and the connecting rods 60 and 62 of the second pair 44. The reference X68 denotes a straight line providing the axis of rotation associated with this pivot link.

The axis of articulation 68 extends along this axis X68, which is called "direction X68" below to avoid any confusion with the axis of articulation 68.

According to some examples, the connecting rods 60 and 62 are arranged on either side of the connecting rods 50 and 52 and are in contact with the connecting rods 50 and 52 over part of their length. The connecting rod 50 is adjacent to the connecting rod 60 and the connecting rod 52 is adjacent to the connecting rod 62.

The pivot link formed by the axis of articulation 68 is formed on the other end of each of the connecting rods 50, 52, 60 and 62, that is to say formed on the second end of the connecting rods 50 and 52 and on the second end of the connecting rods 60 and 62. In practice, the second end of each connecting rod is situated opposite the first end of said connecting rod.

Thus, in the examples illustrated, the pivot link formed by the axis of articulation 68 is situated on the lower end of the connecting rods 60 and 62 and on the upper end of the connecting rods 50 and 52. In these examples, the articulation is therefore formed essentially in the middle of the link system 22.

Some examples of operation of the mechanism 10 will now be described briefly.

In a stable open position, illustrated by FIG. 1, the storage device 34 is armed, that is to say that the spring is compressed and stores energy. The bolt 30 holds the closing pawl 32 in a first position.

To close the contacts 4 and 8, the closing bolt 30 is shifted, for example by the action of the tripping device 12 or the push-button, which releases the closing pawl 32.

The movement of the closing pawl 32 actuates the device 34 and the energy stored in the device 34 is released by a relaxation movement of the spring, and this, by means of the drive mechanism 36, actuates the link system 22, for example by striking the bush 58, so as to move the mobile pole 6 by means of the shaft 20, until the contact finger 8 comes into contact with the fixed contact 4.

The link system 22 continues to move towards its closed position until it passes in front of a predefined alignment position, called «neutral», driving the trip hook 40 and the opening pawl 26 towards an abutment position, in which the link system 22 is prevented from returning backwards.

The linkage 45, and more precisely the first pair of connecting rods 42, then comes into contact with the abutment 48, so as to lock the position of the link system 22.

The mechanism 10 is then in a stable closed position.

To reopen the unit 2, the locking between the opening pawl 26 and the bolt 28 is broken, for example by moving the lever 31 by means of the actuator 12 or by means of a manual action directly on the bolt 28. The opening pawl 26 pivots, releasing the abutment of the trip hook 40.

The link system 22 is then no longer held in abutment by the hook 40, whereas the abutment 48 forces the first pair of connecting rods 42 to move away under the action of the return force exerted by the spring 29, so as to return the link system 22 towards the open position. Once the link system 22 has returned behind the neutral position, the mobile pole 6 is driven towards its open position. The mechanism 10 has returned to the stable open position.

Figure 3:
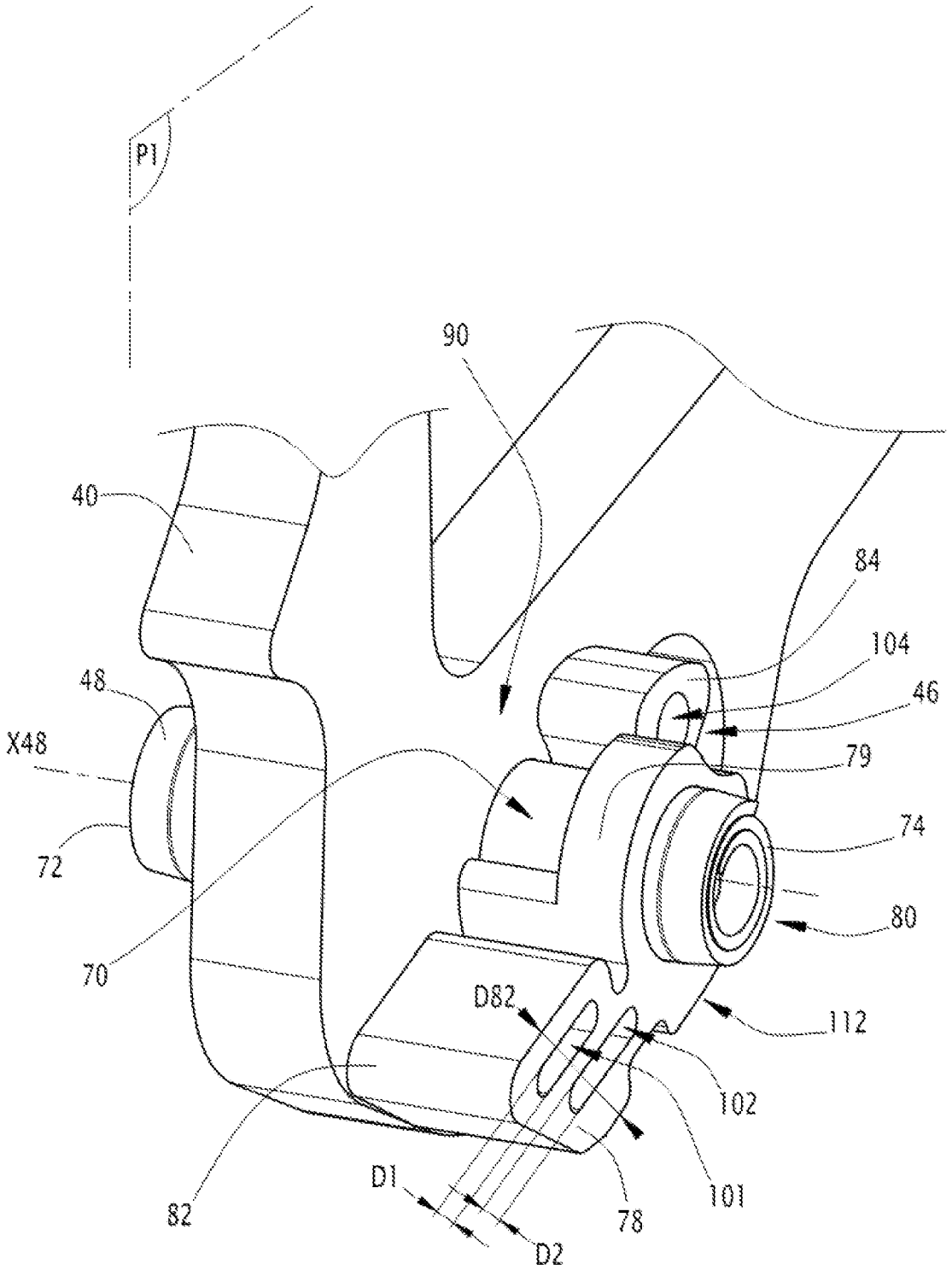
FIG. 3 is a perspective view of certain parts of the linkage in FIG. 2 in an assembled configuration, observed in the direction of the arrow III in FIG. 2.
Figure 4:
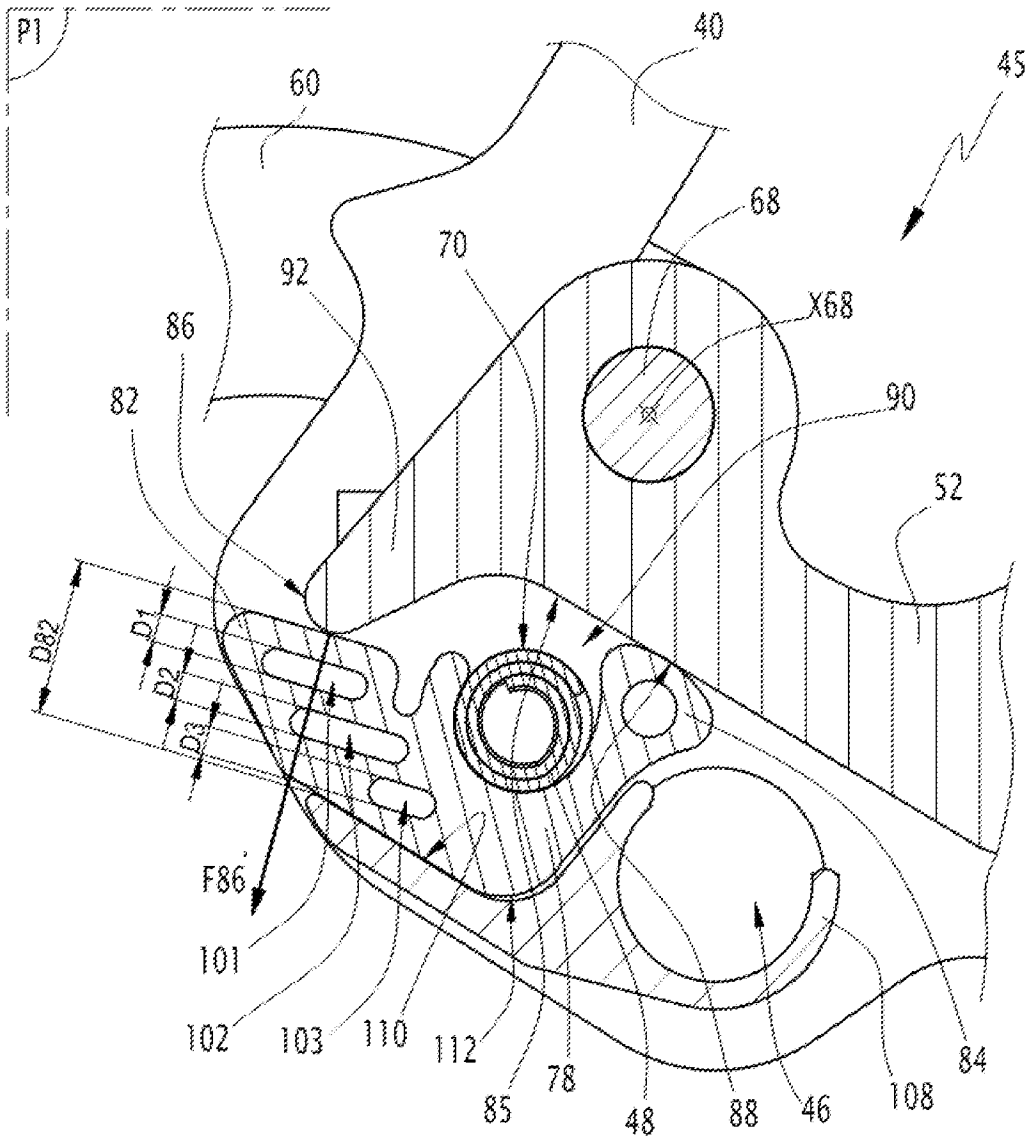
FIG. 4 is a cross-sectional view, on a sectional plane parallel to the median plane, of the linkage in FIG. 2, shown assembled in a third configuration.

As illustrated in this instance in FIGS. 2, 3 and 4, the abutment 48, visible on a larger scale, comprises a spiral pin. The spiral pins, which are described in the standards ISO 8748 and ISO 8750, for example, are formed by a coil of a metal sheet, for example made from high-elasticity steel.

«High-elasticity steel» is understood to mean a steel grade designed to be resistant to impacts and flexure. Many steel grades exist, and a person skilled in the art will be able to select the most suitable grade on the basis of the geometry of the abutment 48 and the expected performance levels, in particular in terms of durability and kinetic energy absorption. As non-limiting examples, hardened steel 420-545 HV or stainless steel "1.4310" grades give good results.

The abutment 48 has a generally cylindrical shape with a circular cross-section, the generatrix of which extends along an axis X48, the axis X48 being parallel to the axis X56, and has an external surface 70 with two opposite ends 72 and 74, which are of frustoconical shape in this instance.

The abutment 48 is introduced tightly into the bore of the hook 40 in which the abutment 48 is housed, the abutment 48 being held in said bore by means of elastic return. In particular, the abutment 48 is not welded to the hook 40 and remains free to be elastically deformed under the effect of an outside force; in particular, the abutment 48 remains free to be deformed by flexure when the connecting rod pair 42 comes to bear on the abutment 48 when the mechanism 10 closes.

A spiral pin of this kind, used as abutment 48, is particularly resistant to impacts and to material fatigue, in particular in comparison with abutments from the prior art, which are generally solid cylinders made from a hard but inflexible steel, or in comparison with split pins. Of course, the abutment 48 can have shapes other than a spiral pin as long as equivalent performance levels in terms of impact resistance are attained.

The switching unit 2 moreover comprises two damping elements 76 and 78.

Each damping element 76 or 78 is situated at the level of a respective end 72 or 74 of the abutment 48, the damping elements 76 and 78 being arranged symmetrically on either side of the hook 40. Advantageously, the damping elements 76 and 78 have a symmetrical structure in relation to the median plane P1.

The dampers 76 and 78 are configured to damp, by means of elastic deformation, the movement of the linkage 45 when the unit 2 passes from the open state to the closed state.

The dampers 76 and 78 are in a configuration referred to as "relaxed" when the switching mechanism 10 is in the open state, and are in a configuration referred to as "deformed" when the switching mechanism 10 is in the closed state, parts of the linkage 45 bearing on the dampers 76 and 78.

Only the damper 78 is visible in FIG. 3, whereas in FIG. 4 only the connecting rod 52 and the damping element 78 are visible. The description that follows is provided in regard to the connecting rod 52 and the damping element 78 only, given that the connecting rod 50 and the damping element 76 have a symmetrical structure and work in the same way.

The damper 78, which is visible in the illustration in FIG. 3, comprises a central portion 79 in the shape of a ring or cylinder, in which an orifice 80 is made, the orifice 80 interacting with the abutment 48 so as to hold the damping element 78 on the abutment 48. The damping element 78 has a front portion 82 and a rear portion 84, which are integral with the central portion 79 and extend on either side of the central portion 79, the rear portion 84 being closer to the distal end 54 of the hook 40 than the front portion 82.

A through-slot 90 is made in the central portion 79 between the front and rear portions 82 and 84, radially with respect to the axis X48. The through-slot 90 allows the connecting rod 52 to pass through, so that when the switching unit 2 is in the closed state the connecting rod 52 bears directly on the abutment 48. More precisely, a main bearing surface 85 of the connecting rod 52 bears directly on the external surface 70 of the abutment 48.

The through-slot 90 allows the damping element 78, made in this instance from elastomer material, to be prevented from shearing off between the connecting rod 52 and the abutment 48, which would bring about rapid deterioration of the damping element 78.

In FIG. 4, the unit 2 is shown in an intermediate configuration between the open state and the closed state during a closing movement of the mechanism 10. In particular, the link system 22 is not yet bearing on the abutment 48. In the intermediate configuration in FIG. 4, the linkage 45 just comes into contact with the damping element 78, which is still in a relaxed configuration. More precisely, the front and rear portions 82 and 84 are in contact with secondary bearing surfaces 86 and 88, respectively, of the connecting rod 52, the secondary bearing surfaces 86 and 88 being situated on either side of the main bearing surface 85.

For illustrative purposes, a mean bearing direction F86 of the secondary bearing surface 86 on the front portion 82 is defined as being the direction of movement of the secondary bearing surface 86 when contact with the front portion 82 occurs, that is to say in the configuration shown in FIG. 4. The mean bearing direction F86 is shown by an arrow in FIG. 4, the arrow F86 being orthonormal with respect to the axis X56 about which the connecting rod 52 pivots.

In particular, the secondary bearing surface 86 is arranged at the end of a protuberance 92 of the connecting rod 52, the protuberance 92 extending so as to project from the end of the connecting rod 52 comprising the axis X68 towards the front portion 82 of the damper 78, in a direction substantially orthoradial with respect to the axis X56 of rotation of the connecting rod 52. The protuberance 92 allows the contact between the bearing surface 86 and the front portion 82 to occur together with the contact between the bearing surface 88 and the rear portion 84, so as to stabilize the damper 78 about the abutment 48.

In the intermediate configuration shown in FIG. 4, it is understood that the front and rear portions 82 and 84 of the damper 78 come into contact with the secondary bearing surfaces 86 and 88 of the linkage 45 before the main bearing surface 85 of the linkage 45 bears directly on the abutment 48, which allows the damping elements 76 and 78 to absorb, by means of elastic deformation, some of the kinetic energy of the linkage 45 before the impact on the abutment 48.

The energy dissipated by damping is usually equal to the work of the contact force between the damper 78 and the connecting rod 52, that is to say equal to the intensity of the contact force multiplied by the amplitude of the movement of the point of contact between the damper 78 and the connecting rod 52.

It is understood that the damping effect is greater if the contact between the damper 78 and the linkage 45 occurs as early as possible before the linkage 45 is in direct contact with the abutment 48. Equally, for the same elastic deformation, a hard, or rigid, elastomer generates a greater force compared with a soft elastomer and the damping effect is greater.

However, if the internal force inside the elastomer material exceeds a certain limit, the material is at risk of deterioration through crushing. It is understood that the harder an elastomer material, the more its ability to be elastically deformed is reduced.

Deformable cavities 101, 102 and 103 are thus made in the front portion 82 of the damper 78, so that the damper 78 is able to be deformed over a large spatial amplitude while being made of a relatively hard elastomer material.

The hardness of elastomers can be evaluated by means of a standardized test called a "Shore hardness test", the results of which are expressed on a scale referred to as "Shore A" ranging from 0° to 100°. "Relatively hard" is understood to mean that the damping element 78 is made from an elastomer material having a hardness, measured on the Shore A scale, of between 50° and 95°. Preferably, the hardness of the elastomer is between 60° and 80°, more preferably substantially equal to 70°.

In the example illustrated, the cavities 101 to 103 each have an elongated oval shape, the length of each of the ovals being arranged perpendicularly with respect to the mean bearing direction F86 of the connecting rod 52.

Similarly, a cavity 104, which has a circular cross-section in this instance, is made in the rear portion 84 of the damping elements 76 and 78.

When the damper 78 is in a relaxed configuration, the cavities 101 to 104 are open, that is to say that internal surfaces of each of the cavities 101 to 104, which are situated opposite one another in the mean bearing direction F86, do not touch, whereas when the switching unit 2 is in the closed state the cavities 101 to 104 are closed, that is to say that the internal surfaces of each cavity 101 to 104 are in contact with one another.

Thus, the combination of a relatively hard elastomer material with cavities 101 to 104 made in the damping elements 76 and 78 allows a higher damping force to be generated, and over a longer spatial amplitude compared with damping elements 76 or 78 without a cavity. In FIG. 4, a dimension D1 is defined as being the dimension of the cavity 101, measured parallel to the mean bearing direction F86, when the damper 78 is in a relaxed configuration. Similarly, the dimension D2 associated with the cavity 102 and the dimension D3 associated with the cavity 103 are defined.

A dimension D82 of the front portion 82 is also defined as being the dimension of the front portion 82, measured parallel to the main bearing direction F86, when the damper 78 is in a relaxed configuration. The cavities 101 to 103 of the front portion 82 represent a total thickness, equal to the sum of the dimensions D1, D2 and D3, of between 30% and 70% of the dimension D82 of the front portion 82. Preferably, the total thickness of the cavities 101, 102 and 103 is between 40% and 60% of the dimension D82 of the front portion 82 of the damping element 78.

Of course, the number and shapes of the cavities 101 to 104 are non-limiting, and cavities having different shapes from the cavities 101 to 104 can be made in the damper 78, as long as similar effects in terms of damping and durability are achieved.

The switching unit 2 comprises, moreover, two spacer strips 106 and 108, which are situated on either side of the hook 40 symmetrically in relation to the median plane P1. The spacer strips 106 and 108 advantageously have a symmetrical structure in relation to the median plane P1.

Each of the spacer strips 106 and 108 is situated at the level of a respective damping element 76 or 78, and has a housing 109 and a support face 110.

The spacer strips 106 and 108 firstly interact with a shaft passing through the orifice 46 and, secondly, the housing 109 interacts with one of the ends 72 or 74 of the abutment 48, so as to secure the spacer strips 106 and 108 to the hook 40.

In the example illustrated, the support face 110 has, in cross-section on the median plane P1, an L shape that interacts in a form fit with a lower face 112 of the damping elements 76 and 78. The lower faces 112 of each of the damping elements 76 and 78 are situated opposite the front and rear portions 82 and 84 in the bearing direction F86 of the linkage 45, so that, in a deformed configuration of the damping elements 76 and 78, the damping elements 76 and 78 are mainly deformed by compression. The support face 110 also allows the rotational movements of the dampers 76 and 78 about the axis X48 of the abutment 48 to be prevented.

For each of the damping elements 76 and 78, the lower face 112 is aligned, in the mean bearing direction F86, with a first section of the front portions 82, which are situated in proximity to the through-slot 90. A second section of the front portions 82, which is remote from the through-slot 90, is not aligned with the lower face 112 in the mean bearing direction F86. In other words, the front portions 82 partially jut out beyond the support faces 112. When the switching unit 2 is in the closed state the front portion 82 of each damping element 76 or 78 thus comprises an area of deformation by tension, which further contributes to damping the linkage 45 over a larger spatial amplitude when the switching unit 2 passes from the open state to the closed state.

Of course, the support face 110 can have shapes other than the L shape illustrated in the figures, as long as the support face 110 allows the dampers 76 and 78 to be supported while allowing the dampers 76 and 78 to be deformed over a larger spatial amplitude.

The embodiment and the variants mentioned above can be combined to generate new embodiments of the invention.

The invention claimed is:

1. A switching unit for switching an electrical current, the unit comprising separable fixed and mobile electrical contacts and a mechanism capable of switching over the contacts between a closed state and an open state, the mechanism comprising:

a switching shaft coupled to the mobile electrical contact;

a trip hook mounted to be pivoted on a fixed support of the mechanism and comprising a bore in which is housed an abutment, a link system coupling the switching shaft to the trip hook, the link system comprising an articulated linkage, which is rotationally linked with respect to the trip hook and which comprises a main bearing surface, which bears on the abutment when the switching mechanism is in the closed state, wherein the abutment is configured to be elastically deformed when the switching mechanism passes from the open state to the closed state and the linkage exerts an effect on the abutment, so as to damp the impact of the linkage on the abutment.

2. The switching unit according to claim 1, wherein the abutment is made from high-elasticity steel.

3. The switching unit according to the claim 2, wherein the abutment comprises a spiral pin.

4. The switching unit according to claim 1, wherein the abutment is held in the bore of the trip hook by means of elastic return of the abutment.

5. The switching unit according to claim 1, wherein the switching unit comprises elastically deformable damping elements, the damping elements being in a relaxed configuration when the switching mechanism is in the open state, whereas, when the switching mechanism is in the closed state, secondary bearing surfaces of the linkage bear on respective bearing portions of the damping elements and the damping elements are in a deformed configuration.

6. The switching unit for switching an electrical current according to claim 5, wherein the damping elements are each situated at a level of a respective end of the abutment and each comprise an orifice to hold them on the abutment, each damping element also comprising a through-slot, so that in the closed state of the switching unit the main bearing surface of the linkage bears directly on the abutment.

7. The switching unit according to claim 6, wherein each damping element comprises a front portion and a rear portion, the front and rear portions being situated on either side of the through-slot and being configured so as, when the trip mechanism passes from the open state to the closed state, to come into contact with the secondary bearing surfaces of the linkage before the main bearing surface of the linkage bears directly on the abutment.

8. The switching unit according to claim 7, wherein the damping elements comprise deformable cavities made in the front portion, the deformable cavities being open when the damping elements are in a relaxed configuration, whereas when the switching unit is in the closed state the deformable cavities are closed.

9. The switching unit according to claim 8, wherein the damping elements are configured so that the cavities in the front portion each have a respective thickness measured parallel to a mean bearing direction, the sum of the thicknesses being between 30% and 70% of a dimension of the front portion measured parallel to the mean bearing direction, the mean bearing direction being defined by the direction of the contact force between the linkage and the front portion when the switching unit passes from the open state to the closed state.

10. The switching unit according to claim 5, wherein the damping elements are made from an elastomer material having a Shore A hardness of between 50° and 90°.

11. The switching unit according to claim 5, wherein the switching mechanism comprises two spacer strips, which are integral with the trip hook and are each situated at a level of a respective damping element, each spacer strip having support faces configured to interact in a form fit with lower faces of the damping elements, the lower faces being situated opposite the front and rear portions in a mean bearing direction of the linkage, so that, in a deformed configuration, the damping elements are deformed by compression.

12. The switching unit according to claim 11, wherein the front portions of the damping elements partially jut out beyond the support faces, so that when the switching unit is in the closed state the front portion of each damping element also comprises an area of deformation by tension.

13. The switching unit according to claim 9, wherein the sum of the thicknesses is between 40% and 60%.

14. The switching unit according to claim 10, wherein the Shore A hardness is between 60° and 80°.

15. The switching unit according to claim 14, wherein the Shore A hardness is substantially equal to 70°.

* * * * *